United States Patent [19]

Naito et al.

[11] 4,266,885

[45] May 12, 1981

[54] METHOD OF CONSTRUCTING A CONTINUOUS CUT-OFF WALL AND A CORE OF A FILL-TYPE DAM

[75] Inventors: Kazuaki Naito, Sayama; Takaiki Tetekawa, Kawaguchi; Shigeyuki Sogo, Sayama; Kazuhiko Higaki, Tokyo; Tetu Yasuoka; Hidetoshi Hosoi, both of Kokubunji, all of Japan

[73] Assignees: Ohbayashi-Gumi Ltd., Osaka; Nichireki Chemical Industry Co., Ltd., Tokyo, both of Japan

[21] Appl. No.: 950,542

[22] Filed: Oct. 12, 1978

Related U.S. Application Data

[63] Continuation-in-part of Ser. No. 815,457, Jul. 13, 1977, abandoned.

[51] Int. Cl.[3] ..... E02B 7/04; E02D 27/00

[52] U.S. Cl. ..... 405/109; 405/116; 405/265; 405/267

[58] Field of Search ..... 405/109, 116, 117, 263–267; 52/742

[56] References Cited

U.S. PATENT DOCUMENTS

| | | | |
|---|---|---|---|
| 922,207 | 5/1909 | Strauss | 405/109 |
| 2,003,921 | 6/1935 | Chevrillon | 405/265 |
| 2,075,244 | 3/1937 | Van Hulst | 405/265 |
| 2,791,886 | 5/1957 | Veder | 405/267 |
| 3,385,068 | 5/1968 | Armentrout | 405/109 |
| 3,422,627 | 1/1969 | Courte | 405/267 |

FOREIGN PATENT DOCUMENTS

| | | | |
|---|---|---|---|
| 348662 | 10/1960 | Switzerland | 405/109 |

OTHER PUBLICATIONS

Civil Engineering, Apr. 1972, pp. 70,71.

German Printed Application No. H 21710 v/84a, Nov. 29, 1956, Pruss.

*Primary Examiner*—David H. Corbin

*Attorney, Agent, or Firm*—Armstrong, Nikaido, Marmelstein & Kubovcik

[57] ABSTRACT

The present invention relates to a method of constructing a continuous cut-off wall and a core of a fill-type dam in the ground by placing or grouting at a normal temperature a mixture of a cold-setting property comprising a cement, coarse and fine aggregates and a bituminous emulsion in a certain range of composition (hereinafter referred to as a cement bitumen concrete or a CA concrete), or a mixture of a cold-setting property comprising a cement, fine aggregate and a bituminous emulsion in a certain range of composition (hereinafter referred to as a cement bitumen mortar or a CA mortar) and further constructing an extended core of a fill-type dam above the continuous cut-off wall.

5 Claims, 13 Drawing Figures

METHOD OF CONSTRUCTING A CONTINUOUS CUT-OFF WALL AND A CORE OF A FILL-TYPE DAM

This is a continuation-in-part of application Ser. No. 815,457 filed July 13, 1977, now abandoned.

BACKGROUND OF THE INVENTION

1. Field of the Invention

The present invention relates to a method of employing a mixture of a cold-setting property comprising cement, bituminous emulsion and aggregate with impermeability and flexibility under a normal temperature constructing a continuous cut-off wall which can be utilized for stoppage of water leakage from foundation soil of a fill-type dam, such as an earth dam or a rock-fill dam, a cut-off for foundation soild of a levee, prevention of water permeation into a foundation soil of a dock and a cut-off in put excavation and shield works and the like.

Furthermore, this invention also relates to a method for constructing a core of shielding water for fill-type dams such as earth dams and rock-filled dams.

2. Description of the Prior Art

In recent years, a number of earth and rock-filled dams have been constructed. The dams had formerly been constructed on a bedrock excellent in shielding water, which is encountered after continuous excavation. However, the dams are lately driven by necessity to be constructed directly on an accretion layer of vast thickness which is highly permeable without removing the accretion layer for economical reasons.

As for the aforementioned case, there has been adopted "a certain grout method", so called, which impregnates cement milk and other chemical grouting into the ground through borings as a shielding method of water for the accretion layer, but it does not provide a continuous film of shielding water for certain.

A sheet pile method and an impregnation method have hitherto been put into practice for a cut-off for foundation soil of a levee, prevention of water permeation into foundation soil of a dock and a cut-off in pit excavation and shield works.

In the former case, it is difficult to perfect prevention of leakage from joints between sheets and, in the latter case, it is very expensive. For overcoming these disadvantages, there is a method for constructing a continuous cut-off wall by filling a cement concrete into a pit of wall-shaped excavation in the ground, in which the continuous cut-off wall is too hard to follow distortion of a foundation soil and apt to be cracked without a satisfactory result of effecting the cut-off.

Under the circumstances as mentioned above, there has been a method of constructing a cut-off wall wherein a hot asphalt mixture of heat-mixing asphalt and aggregate such as asphalt concrete, and Gussasphalt or mastic asphalt is grouted. However, when a pit of a wall shape is excavated in the ground and is used with mud water of bentonite in order to prevent a collapse of a foundation soil, the hot asphalt mixture has been hard in executing works and apt to be set by being cooled with water during grouting, and to cause spaces with the water being boiled, thereby accompanying drawbacks of difficult quality control and danger. Therefore, it has been demanded to develop a method of obtaining and constructing a material which is placed at a normal temperature as in the case of the conventional cement concrete and provides a flexibility and impermeability, as in the case of the hot asphalt mixture, offering a uniform quality.

A core material for a fill-type dam has been formed of compaction of natural soil such as clay or heated asphalt concrete. In recent years, the application of the asphalt concrete has been increased since clay of good quality became hard to obtain, the execution of works is apt to be influenced by weather and the endurance for earthquake is troublesome. However, the asphalt concrete has necessitated an asphalt concrete plant for heating which requires large scale equipment and decreased efficiency since the height of one execution of works has been only some 10 cm, due to the rolling compaction required for the asphalt concrete.

SUMMARY OF THE INVENTION

The purpose of this invention resides in constructing a cut-off wall of impermeability conformable to movement of foundation soil and without rupture under earth pressure by using a cement bitumen mixture of a cold-setting property comprising cement, bituminous emulsion and aggregate under a normal temperature in overcoming such disadvantages.

Furthermore, the purpose of this invention resides in constructing a core having flexibility and high impermeability by employing a cement bitumen mixture of a cold-setting property which is in a high workability to be placed under a normal temperature without being influenced by weather.

The present invention relates to a method of constructing a continuous cut-off wall with flexibility by placing or impregnating CA concrete (indicating a cement bituminous concrete of a cold-setting property comprised of cement, fine aggregate, coarse aggregate and bituminous emulsion) comprising cement 80–250 kg/m$^3$, fine aggregate 600–1000 kg/m$^3$, coarse aggregate 800–1200 kg/m$^3$ and bituminous emulsion with evaporation residue of above 60 wt% 200–400 kg/m$^3$, or CA mortar (indicating a cement bitumen mortar of a cold-setting property composed of cement fine aggregate and bituminous emulsion) comprising cement 200–800 kg/m$^3$, fine aggregate 300–1500 kg/m$^3$ and bituminous emulsion with evaporation residue of above 60 wt% 300–900 kg/m$^3$ into a pit excavated in the ground in a wall shape. Throughout the specification and claims, kg/m$^3$ means kg weight of an employed material per 1 m$^3$ of CA concrete or CA mortar. To construct the continuous cut-off wall, the pit of wall shape is practically excavated by a continuous underground wall excavator and then deposited with the CA concrete or the CA mortar emulsion through a tremie pipe, etc. Or, for example, steel sheet piles with impregnating holes are driven into the ground and drawn up to make gaps which are impregnated with CA mortar through the holes.

Further, the CA concrete or CA mortar employed in the present invention can be placed into a form arranged to raise the height of one placing execution and can be compacted by a vibrator or the like in order to construct a core.

BRIEF DESCRIPTION OF THE DRAWINGS

These and other objects and advantages of the present invention will become more fully apparent as the following description is read in conjunction with the drawings wherein.

DESCRIPTION OF THE PREFERRED EMBODIMENTS

Figure 1:
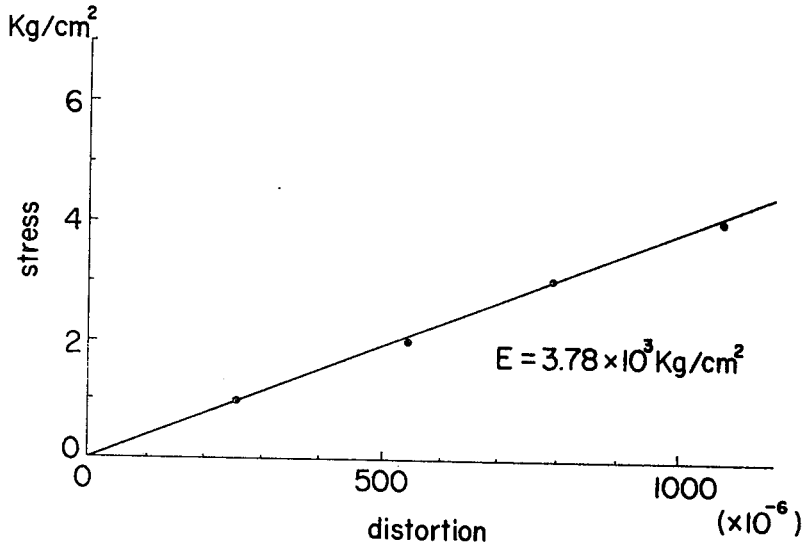
FIGS. 1 and 2, respectively, represent a diagram of a relationship between stress and strain of CA concrete (indicating a cement bitumen concrete used on this invention) specimen in flexibility test.

Cements employed in this invention are Portland cement (it contains four kinds of ordinary, high early strength, superhigh early strength and moderate heat cements), silica cement, fly-ash cement, Portland blast furnace cement, calcium aluminate cement, super rapid quick-setting cement and sulfate resistant cement, etc. but are generally Portland cements. The cement may be used with hardening accelerator, hardening modifier, hardening delay agent, AE agent, dispersant and defoaming agent. For example, the hardening accelerator includes calcium chloride, aluminum chloride, water glass, limes, gypsums, amines, ethylene glycols, calcium aluminates, calcium sulfoaluminates and aluminates.

A fine aggregate usable in this invention is sand, which includes river sand, sea sand and pit sand, and also includes an artificial sand such as silica sand, glass-crushed sand, ferric sand, sintered ash sand, slag sand and foundry sand etc.

A coarse aggregate usable in this invention includes, in general, gravel, crushed stone, unscreened crushed stone and modified grading crushed stone, and also includes an artificial aggregate such as slag, emery, crushed pottery and glass, crushed concrete, metallic grain and crushed plastics.

The bituminous emulsion to be used in this invention is an emulsion formed by emulsifying a bituminous material in water with at least one member selected from the group consisting of a cationic, anionic, amphoteric, nonionic surface active agent and a clay as the main emulsifier. Acids, alkalis, salts, protective colloids, bentonite, clay or the like can also be used to emulsify the bituminous material in water with the main emulsifier. An acid is used primarily with the cationic, amphoteric and/or nonionic surface active agent. An alkali is used mainly with the anionic, amphoteric and/or nonionic surface active agent, and a salt is used with the cationic, anionic, amphoteric and/or nonionic surface active agent.

These acids, alkalis, salts, protective colloids, clays or the like may be added to the emulsion to adjust the properties thereof also.

The bituminous material to be used for the formation of the bituminous emulsion includes (1) "bituminous material" composed of one or a mixture of more than two members selected from straight asphalt, blown asphalt, semiblown asphalt, natural lake asphalt (Trinidad asphalt, for example), propane precipitated asphalt, cut-back asphalt, coal tar, oil tar, tar pitch, petroleum pitch, tall oil pitch, fatty acid pitch, heavy oil; and (2) "rubber and/or resin modified bitumen" obtained by adding and mixing rubbers and/or resin (such as natural rubber, isopren rubber, styrene-butadiene rubber, styrene rubber, styrene-isoprene rubber, chloroprene rubber, polybutadiene rubber, acrylonitrile-butadiene rubber, butyl rubber, EPT rubber, styrene-isoprene block polymer rubber, styrene-butadiene block polymer rubber, polyethylene, polyacrylate, ethylene-vinylacetate copolymer, ethylene-acrylate copolymer or the like) into the above bituminous materials.

An emulsion formed by adding a rubber latex and/or a resin emulsion to the above-mentioned bituminous emulsion may also be used as the bituminous emulsion in this invention.

Any of the cationic, anionic, amphoteric, nonionic and clay-type emulsions may be used as the bituminous emulsion.

All kinds of emulsions can be made which are mixed homogeneously with the hydraulic material, such as cement and cement mixtures containing cement, an aggregate, a filler or a forming agent, in a chemically and mechanically stable state, so as not to disturb the hydration reaction of the hydraulic materials.

The bituminous emulsion contains generally a bituminous material content (evaported residue) of from 60–75% by weight. The penetration at 25° C. of the evaporated residue of the bituminous emulsion may be in the range of 10 to 300 generally, too. The bituminous emulsion is preferable in a higher concentration in which more than 60 wt% of evaporated residue content is desirable. The high concentration emulsion (evaporated residue content more than 60 wt%) is of less foaming property in an occasion of mixing with aggregates, and is advantageous in obtaining a good mixture with aggregates due to no excessive moisture and, moreover, excels in working properties due to easy adjustment of moisture. To obtain a conspicuous defoaming property, a defoaming agent such as silicon may be used with emulsion. The lower foaming and defoaming properties of the bituminous emulsion are particularly important to obtaining a water-tight property for the cut-off wall and the core of this invention.

The most general bituminous emulsion of the above-mentioned emulsions is an emulsified asphalt or an emulsified asphalt containing elastomer. When oil resistance is required for the CA mortar or the CA concrete, an emulsion wherein a part or whole of the bituminous material of the emulsion is replaced by coal tar, coal tar pitch, elastomer modified coal tar, or elastomer modified coal tar pitch.

The CA concrete used in this invention are prepared by mixing the aforementioned materials in a ratio of cement is 80–250 kg/m$^3$, fine aggregate is 600–1000 kg/m$^3$, coarse aggregate is 800–1200 kg/m$^3$, and bituminous emulsion with evaporation residue content of above 65 wt% is 200–400 kg/m$^3$. The CA mortar used in this invention are prepared by mixing the aforementioned materials in a ratio of cement is 200–800 kg/m$^3$, fine aggregate is 300–1500 kg/m$^3$ and bituminous emulsion with evaporation residue content of above 60 wt% is 300–900 kg/m$^3$. And these CA concrete or CA mortar are made by mixing those materials by pugmill mixer, soil mixer, cement concrete mixer and cement mortar mixer. A batch mixer is preferable to a continuous one in order to maintain a uniformity of mixing. The order of the materials added to a mixer is not provided but is selected according to the convenience of the works.

The limitations on the ratio of the materials in the above composition concerns the endurance of the cut-off wall, particularly with the importance of stability (strength), flexibility and water tight property of the CA concrete and the CA mortar. In the composition of the CA concrete, a cement content of less than 80 kg/m$^3$ results in insufficient strength of concrete in an initial period and a long term. On the other hand, the cement content of more than 250 kg/m$^3$ results in less flexibility due to an excessive rigidity which is unable to follow the strain of a surrounding soil and leads to the production of cracks which spoil the cut-off wall.

The above condition is also concerned with the quantity of bituminous emulsion used. Bituminous emulsion content of less than 200 kg/m$^3$ does not render a sufficient flexibility. On the other hand, more than 400 kg/m$^3$ results in a lower stability and increases a slump, although becoming good in a water tight property so that the separation of aggregates is liable to occur and further raises cost.

In the composition of the CA mortar, the cement content of less than 200 kg/m$^3$ results in insufficient strength and lower stability and, on the other hand, more than 800 kg/m$^3$ results in loss of flexibility. As to the quantity of bituminous emulsion used, content of, less than 300 kg/m$^3$ is wanting in flexibility and water tight property. On the other hand, more than 900 kg/m$^3$ decreases stability with a better water tight property and is liable to produce separation of aggregates and further raises cost.

In preparing the CA concrete or the CA mortar, moisture is generally sufficient with the moisture contained in the bituminous emulsion used and, therefore, there is no need of actually adding water; however, water may be added if necessary.

The characteristics and properties of the CA concrete and CA mortar used in the present invention will become more apparent from the following description of experimental examples.

The materials used in CA concrete or CA mortar are as follows:

Cement:

Portland cement ordinary type

Bituminous Emulsion:

Nonionic emulsified asphalt evaporat residue 66 weight%, penetration at 25° C. of the evaporate residue is 85.

Fine aggregate:

Sand from the river Tonegawa, Chiba prefecture, Japan, having particle size under 2.5 mm, and density of 2.60 g/cm$^3$.

Coarse Aggregate:

Gravel from the river Tonegawa, having a particle size under 25 mm and a density of 2.61 g/cm$^3$.

EXAMPLE 1

Figure 2:
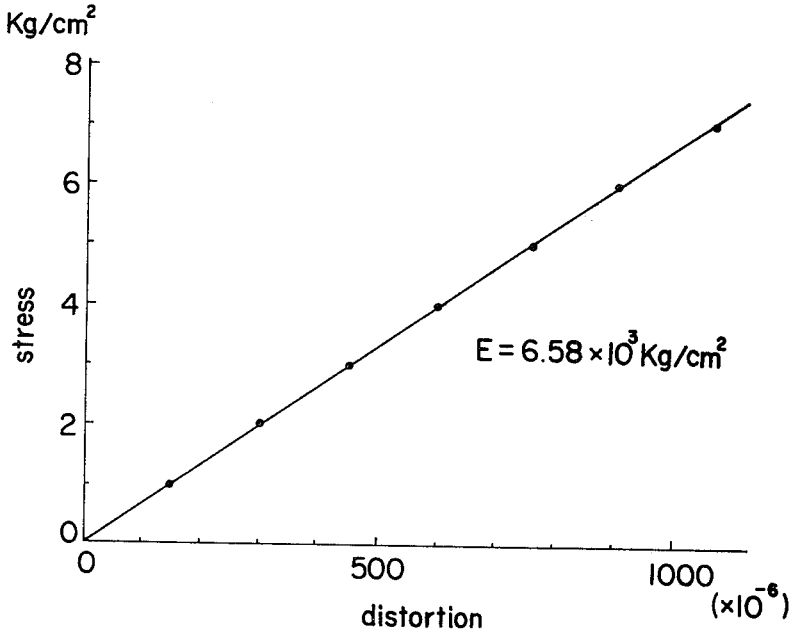

Specimens of CA concrete (age 28 days) obtained from CA concrete having the composition of Table 1-1 and Table 1-2 were subjected to a flexibility test. FIGS. 1 and 2 indicate the relationship between stress and strain in the flexibility test.

TABLE 1-1

| Composition Table (kg) | | | |
|---|---|---|---|
| Cement | Bituminous Emulsion | Fine Aggregate | Coarse Aggregate |
| 100 | 265 | 874 | 903 |

Table 1-2

| Composition Table (kg) | | | |
|---|---|---|---|
| Cement | Bituminous Emulsion | Fine Aggregate | Coarse Aggregate |
| 150 | 285 | 795 | 899 |

EXAMPLE 2

Figure 3A:
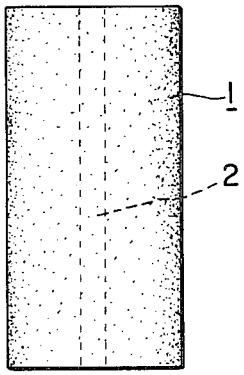
FIGS. 3(A) and 3(B) are elevational and plan views of a specimen for a permeability test made of CA concrete in a preferred embodiment.
Figure 3B:
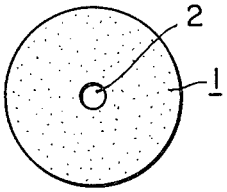

Specimens of a cylindrical CA concrete of 15 cm in diameter and 30 cm in height, with a pierced hole 2 of 2 cm in diameter along a central line as illustrated in FIG. 3 formed by CA concrete having the composition of Table 2 at normal temperature, was subjected to a permeability test. Table 2 shows the results of the permeability test.

TABLE 2

Result of Compressive Strength and Permeability Tests of CA concrete (age : 28 days)

| Composition No. | Coarse aggregate maximum dimension (mm) | Slump (cm) | Ratio of fine aggre. in aggre. (%) | Cement (kg) | Bituminous emulsion (kg) | Fine aggregate (kg) | Coarse aggregate (kg) | Compressive strength (kg/cm$^2$) | Permeable coefficient (k) (cm/sec) |
|---|---|---|---|---|---|---|---|---|---|
| 1 | 25 | 20 | 49 | 100 | 265 | 874 | 903 | 7 | $8.18 \times 10^{-7}$ |
| 2 | 25 | 30 | 47 | 150 | 285 | 795 | 889 | 17 | $6.93 \times 10^{-9}$ |
| 3 | 25 | 20 | 45 | 200 | 305 | 718 | 871 | 29 | $9.89 \times 10^{-11}$ |

Figure 4:
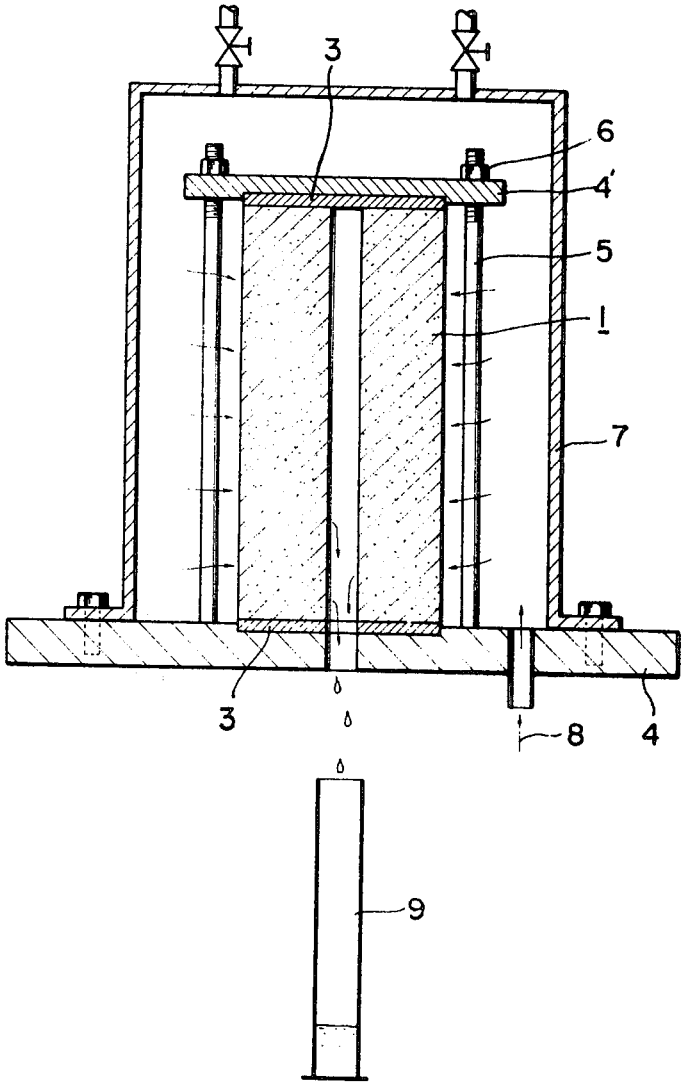
FIG. 4 is a view indicating a method for the permeability test in the specimen of FIG. 3.

A method of experiment for Example 2 is illustrated in FIG. 4. CA concrete specimen 1 was attached with upper and lower packings 3 and set on a sole plate 4 with pierced hole using locking iron plate 4', bolt 5 and nut 6. Then specimen 1 was received into an upper cover 7 of a pressure case and a pressure water was injected into the upper cover 7 through inlet 8. The water flows through the specimen 1 to a measuring cylinder 9 beneath and the volume of water was measured.

The water volume was measured by applying a measuring pressure to the specimen of CA concrete and a permeable coefficient K (cm/sec) was calculated from the following formula:

$$K = \frac{\rho \log e^{\frac{r_o}{r_i}}}{2\pi h} \cdot \frac{Q}{P_o \sim P_i}$$

Q: Volume of leaked water ($cm^3$/sec)
$P_o$, $P_i$: Water pressure on outer and inner surfaces of the hollow cylindrical specimen ($kg/cm^2$)
$r_o$: Radius of the specimen (cm)
$r_i$: Radius of central hole of the specimen (cm)
$\rho$: A density of water
h: Height of the specimen (cm)

EXAMPLE 3

Figure 5A:
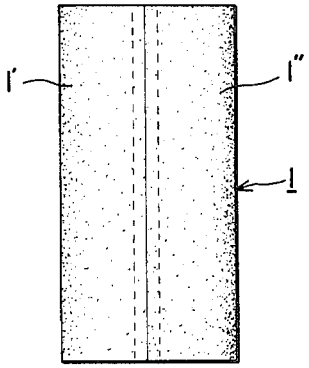
FIGS. 5(A) and 5(B) are elevational and plan views of a specimen of CA concrete for the permeability test.
Figure 5B:
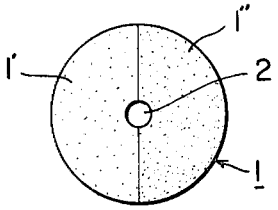

As shown in FIG. 5, a cylindrical piece such as illustrated in example 2 was made by placing CA concrete into a mold and then cut by a concrete cutter after 7 days of age to form a half-cylindrical piece 1'. The piece 1' was set into a mold and then another half-cylindrical piece 1'' was deposited to form CA concrete specimen 1 having pierced hole 2. A permeability test was carried out to examine influence on construction joint between pieces 1' and 2''. Table 3 indicates the composition of CA concrete used in the test. The test results indicated no difference from the case of a whole construction as shown Table 4.

TABLE 3

| Coarse Aggre.-Max Dimension (mm) | Slump (cm) | Fine Aggre. Ratio in aggregate (%) | Cement (kg) | Bitum. Emulsion (kg) | Fine Aggre. (kg) | Coarse Aggre. (kg) |
|---|---|---|---|---|---|---|
| 25 | 20 | 47 | 150 | 285 | 795 | 889 |

TABLE 4

Result of the permeability test for 1'' portion of specimen being 28 days of age and 1' portion of specimen being 35 days of age:

| Piece No. of CA Concrete | Piece No. 1' Only | Joint Placing of No. 1' and 1'' | Piece No. 1'' Only |
|---|---|---|---|
| Permeable Coefficient K (cm/sec) | $6.00 \times 10^{-9}$ | $6.80 \times 10^{-9}$ | $6.93 \times 10^{-9}$ |

EXAMPLE 4

Figure 6A:
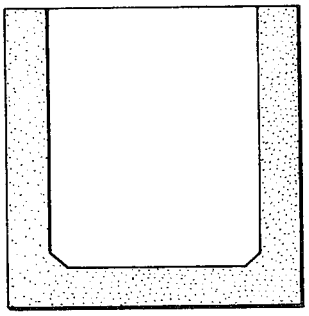
FIGS. 6(A) and 6(B) are an elevational view of a longitudinal section, and a plan view of a transverse cross-section for a specimen of CA concrete in a leakage test of an experimental Example 5.
Figure 6B:
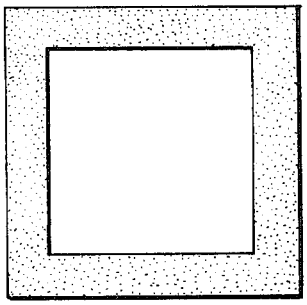

Specimen of CA concrete of approximately 0.4 $m^3$ in inner volume shown in FIG. 6 was formed at the normal temperature by using CA concrete having the composition of Table 5 and the upper surface of the specimen was covered by vinyl chloride polymer film to prevent evaporation of water for the purpose of the permeability test. The results indicated that a lowering of water level to be measured was not observed.

TABLE 5

| Composition Volume of CA concrete : 0.5$m^3$ | | | | | | |
|---|---|---|---|---|---|---|
| Coarse Aggre.-Max Dimension (mm) | slump (cm) | Fine Aggre. Ratio in aggregate (%) | Cement (kg) | Bitum. Emulsion (kg) | Fine Aggre. (kg) | Coarse Aggre. (kg) |
| 25 | 20 | 47 | 150 | 285 | 795 | 889 |

EXAMPLE 5

Figure 7A:
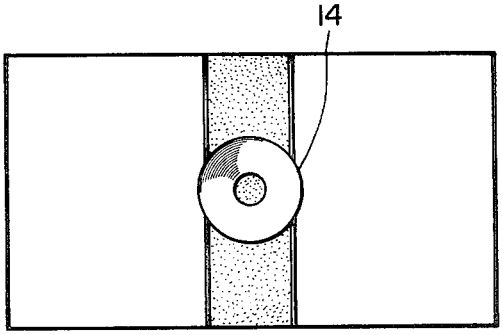
FIGS. 7(A) and 7(B) are an elevational view of a longitudinal section and a plan view of a transverse cross-section for constructing a cut-off wall in mud water of bentonite by using CA concrete.
Figure 7B:
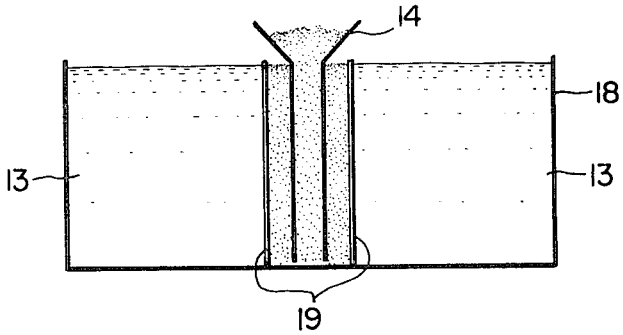

As shown in FIG. 7, CA concrete wall was deposited at the normal temperature by placing CA concrete having the composition of Table 6 in mud water of bentonite through the tremie pipe. Water in one side of a water tank was drained after five days of age, but water in another side of the water tank hardly leaked, thus proving that a cut-off wall of good quality was made in mud water of bentonite the same as in the air.

TABLE 6

| Composition | | | | | | |
|---|---|---|---|---|---|---|
| Coarse Aggre.-Max Dimension (mm) | Slump (cm) | Fine Aggre. Ratio in aggregate (%) | Cement (kg) | Bitum. Euml-sion (kg) | Fine Aggre. (kg) | Coarse Aggre. (kg) |
| 25 | 20 | 47 | 150 | 285 | 795 | 889 |

In FIG. 7 indicates tremie pipe 14, mud water of bentonite 13, water tank 18 and plywood mold 19.

The present invention may be embodied in other specific forms without department from the spirit or essential characteristics thereof. The presently disclosed embodiments are, therefore, to be considered in all respects as illustrative and not restrictive, the scope of the invention being indicated by the appended claims rather than the foregoing description, and all changes which come within the meaning and range of equivalency of the claims are, therefore, to be embraced therein.

Figure 8:
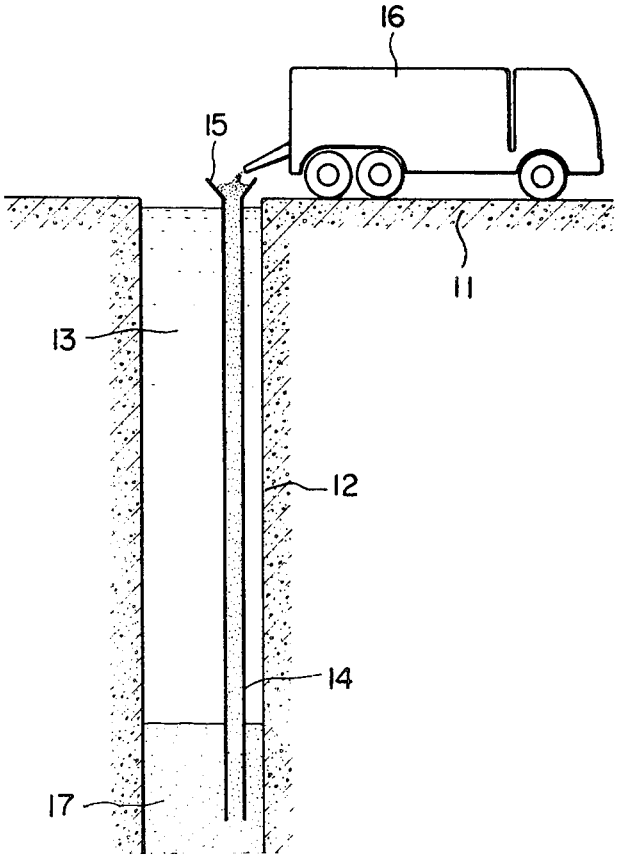
FIG. 8 is a transverse sectional view of a preferred embodiment for constructing a continuous cut-off wall.
Figure 9:
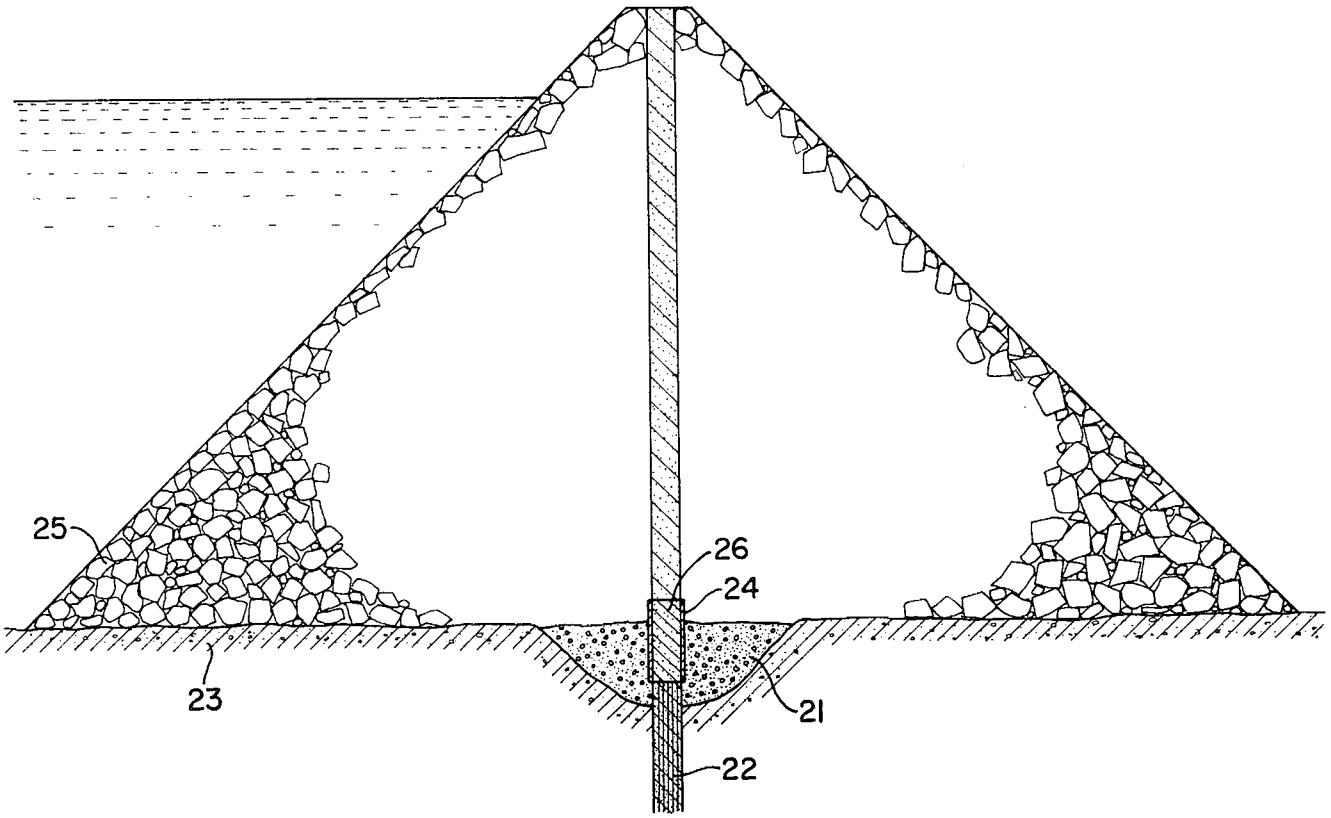
FIG. 9 is a view of another preferred embodiment for constructing a core of a fill-type dam.

FIGS. 8 and 9 illustrate Embodiments I and II of the present invention which are to be referred to in the following description:

EMBODIMENT I

As shown in FIG. 8, a pit of a wall shape 12 is excavated in the foundation soil 11 of a dam by a continuous underground wall excavator, etc. On the occasion of excavation, the excavated pit 12 is filled with mud water of bentonite 13 to prevent collapse of the pit of a wall shape 12. A tremie pipe 14 is inserted into the pit 12 and the CA concrete 17 is poured into the pit 12 through the tremie pipe 14 through hopper 15 from a concrete truck 16 so as to replace said mud water 13 and a first segment at normal temperature is filled in full depth of the pit and is setted to form a first cut-off wall segment; following said first cut-off wall segment thus constructed, constructing a second cut-off wall segment in the same manner as said first cut-off wall segment, said second cut-off wall segment being positioned adjacent to an end of said first cut-off wall segment so as to connect and form a continuous extension of said first cut-off wall segment; and constructing each subsequent cut-off wall segment in like manner one after another so as to form a continuous cut-off wall in the earth.

EMBODIMENT II

As shown in FIG. 9, cut-off wall 22 is constructed in the foundation soil 23 by grouting, etc. and then the upper part of the cut-off wall 22 is excavated to expose the upper part of the wall 22.

Then, after a form 24 is set on the upper part of the cut-off wall 22, CA concrete 26 is deposited at the normal temperature into space in the form 24. After CA concrete 26 is hardened, the form 24 is removed and sand and gravel are filled and compacted sufficiently.

Furthermore, after a form 24 is set on the upper part of the hardened CA concrete 26, CA concrete is again deposited at the normal temperature into space in the form. The compaction of CA concrete is efficiently carried out by vibrator, etc.

After the CA concrete is hardened, the form is removed and then earth, gravel, stones and rocks 25 are piled up and compacted.

Again a form is set on the hardened CA concrete and CA concrete is again deposited at the normal temperature. The same processes are repeated.

According to the materials piled up, they are called a rock filled dam, an earth dam and so on.

Further, the core of this invention is constructed at one end or both ends of the skirt in the foundation soil of a dam to effect a cut-off property of the dam.

The novel features of this invention for the construction of the cut-off wall are summarized as follows:

1. A structure constructed by CA concrete or CA mortar under a normal temperature allows to give flexibility by mixing the bituminous emulsion which follows strain of the soil to function as a water-shielding wall and is adjusted by the quantity of the emulsion as required. In other words, the more quantity of the emulsion gives the larger of flexibility.
2. The structure constructed by CA concrete or CA mortar under normal temperature is a good cut-off wall since the permeability coefficient of the structure is smaller than that of a cement concrete. The elongation of the structure becomes larger by the addition of the emulsion and therefore does not produce cracks with the strain of the surrounding soil.
3. Since a continuous underground wall excavator, etc., can be used for the construction, the execution and administration of the works are simplified and make it possible to construct accurate water-shielding structures.

The novel features of this invention for the construction of the core for the fill-type dam are summarized as follows:

1. A simple execution of the works. A core of clay is influenced by bad weather due to failure of a rolling compaction, but the core of this invention is not influenced by weather. A core of asphalt concrete necessitates a heated mixing plant and a rolling compaction device and is unable to raise height of one concrete placing. Whereas, the core constructed by CA concrete or CA mortar of this invention is subjected to an easy execution of works at a normal temperature as an ordinary concrete construction and is able to raise height of one concrete placing in raising height of form for one concrete placing, and further does not necessitate the rolling compaction.
2. An optional flexibility of the core constructed by CA concrete or CA mortar depends on the composition. In the fill-type dam, it is ideal that the core material corresponds in stress to strain of a dam structure. This invention can adjust flexibility of the core by adjusting quantity of the bituminous emulsion. A cement concrete is smaller in flexibility and therefore is not preferable to the core.
3. An accurate execution of the core is deposited since the CA concrete or the CA mortar is placed at the normal temperature after setting forms.
4. The core constructed by CA concrete or CA mortar under the normal temperature is a cut-off wall of good quality since the permeability coefficient of the core is smaller than that of a cement concrete. The elongation of the core becomes large by adding the bituminous emulsion and does not lower the cut-off property if the strain of the surrounding soil occurs.

What is claimed is:

1. In a method of constructing a continuous cut-off wall comprising the steps of:

excavating a first wall-shaped pit in the earth;

introducing bentonite slurry into the pit being excavated;

inserting a tremie pipe into said pit;

inserting through said tremie pipe into said wall-shaped pit an impermeable material by replacing said mud water to form a first cut-off wall segment; and following said first cut-off wall segment thus constructed, constructing a second cut-off wall segment in the same manner as said first cut-off wall segment, said second cut-off wall segment being positioned adjacent to an end of said first cut-off wall segment so as to connect and form a continuous extension of said first cut-off wall segment; and constructing each subsequent cut-off wall segment in like manner one after another so as to form a continuous cut-off wall in the earth, the improvement wherein said impermeable material comprises at ambient temperature a cement bitumen concrete of a cold-setting property comprising cement 80–250 kg/m$^3$, fine aggregate 600–1000 kg/m$^3$, coarse aggregate 800–1200 kg/m$^3$ and bituminous emulsion 200–400 kg/m$^3$, or a cement bitumen mortar of a cold-setting property comprising cement 200–800 kg/m$^3$, fine aggregate 300–1500 kg/m$^3$ and bituminous emulsion 300–900 kg/m$^3$.

2. The improvement of constructing a continuous cut-off wall as defined in claim 1, wherein an evaporated residue of said bituminous emulsion is of more than 60 wt.%.

3. In a method of constructing a core of fill-type dam comprising the steps of:

setting a form on an upper part of a cut-off wall constructed in the foundation soil of a dam; and introducing into said form an impermeable material to form a core, the improvement wherein said impermeable material comprises a cement bitumen concrete of a cold-setting property comprising cement 80–250 kg/m$^3$, fine aggregate 600–1000 kg/m$^3$, coarse aggregate 800–1200 kg/m$^3$ and bituminous emulsion 200–400 kg/m$^3$, or cement bitumen mortar of a cold-setting property, comprising cement 200–800 kg/m$^3$, fine aggregate 300–1500 kg/m$^3$ and bituminous emulsion 300–900 kg/m$^3$ at ambient temperature.

4. The improvement of constructing a core of a fill-type dam as defined in claim 3, wherein an evaporated residue of said bituminous emulsion is of more than 60 wt.%.

5. In a method of constructing a core of a fill-type dam as defined in claim 3, wherein said cut-off wall constructed in the foundation soil of said dam is constructed by a method comprising the steps of:

excavating a first wall-shaped pit in the earth;

introducing bentonite slurry into the pit being excavated;

inserting a tremie pipe into said pit;

inserting through said tremie pipe into said wall-shaped pit an impermeable material by replacing said slurry to form a first cut-off wall segment; and following said first cut-off wall segment thus constructed, constructing a second cut-off wall segment in the same manner as said first cut-off wall segment; said second cut-off wall segment being positioned adjacent to an end of said first cut-off wall segment so as to connect and form a continuous extension of said first cut-off wall segment; and constructing each subsequent cut-off wall segment in like manner one after another so as to form a continuous cut-off wall in the earth, the improvement wherein said impermeable material comprises a cement bitumen concrete comprising cement 80–250 kg/m$^3$, fine aggregate 600–1000 kg/m$^3$, coarse aggregate 800–1200 kg/m$^3$ and bituminous emulsion 200–400 kg/m$^3$, or a cement bitumen mortar comprising cement 200–800 kg/m$^3$, fine aggregate 300–1500 kg/m$^3$ and bituminous emulsion 300–900 kg/m$^3$.

* * * * *